US010015858B1

(12) United States Patent
Felty et al.

(10) Patent No.: US 10,015,858 B1
(45) Date of Patent: Jul. 3, 2018

(54) DEEP DIMMING CONTROL IN LED LIGHTING SYSTEM

(71) Applicant: GE LIGHTING SOLUTIONS, LLC, East Cleveland, OH (US)

(72) Inventors: Jeffrey Glenn Felty, Elyria, OH (US); David Joseph Tracy, East Cleveland, OH (US)

(73) Assignee: GE LIGHTING SOLUTIONS, LLC, East Cleveland, OH (US)

( * ) Notice: Subject to any disclaimer, the term of this patent is extended or adjusted under 35 U.S.C. 154(b) by 0 days.

(21) Appl. No.: 15/838,797

(22) Filed: Dec. 12, 2017

(51) Int. Cl.
*H05B 37/02* (2006.01)
*H05B 33/08* (2006.01)

(52) U.S. Cl.
CPC ..... *H05B 33/0845* (2013.01); *H05B 33/0818* (2013.01); *H05B 37/02* (2013.01)

(58) Field of Classification Search
CPC . H05B 37/02; H05B 33/0845; H05B 33/0818
USPC ..... 315/297
See application file for complete search history.

(56) References Cited

U.S. PATENT DOCUMENTS 8,816,604 B2 8/2014 Carli
2010/0060200 A1* 3/2010 Newman, Jr. ..... H05B 41/2822 315/307
2011/0194315 A1* 8/2011 Gaknoki ..... H02M 3/33507 363/21.17
2012/0056552 A1* 3/2012 Yu ..... H05B 33/0815 315/245
2012/0212142 A1* 8/2012 Ryu ..... H05B 33/0815 315/186
2012/0286696 A1* 11/2012 Ghanem ..... H05B 33/0815 315/291
2013/0038233 A1* 2/2013 Chu ..... H05B 33/0815 315/224
2014/0009081 A1* 1/2014 Fujiwara ..... H02M 1/08 315/224
2015/0173145 A1* 6/2015 Lee ..... H05B 33/0815 315/200 R
2015/0216009 A1* 7/2015 Lee ..... H05B 33/0845 315/307
2016/0181927 A1* 6/2016 Chang ..... H02M 1/42 363/21.02
2017/0070141 A1* 3/2017 Mahmoudi ..... H02M 3/157
(Continued)

*Primary Examiner* — Don Le
(74) *Attorney, Agent, or Firm* — Peter T. DiMauro; GE Global Patent Operation

(57) ABSTRACT

Provided is a deep dimming control method and a driver control circuit for controlling brightness to a plurality of LEDs, that includes a controller which generates a first pulse width modulation signal, and a second pulse width modulation signal is used to switch between closed loop control and open loop control of the light intensity of the LEDs, and at least one comparator configured to receive the first PWM signal or the second PWM signal from the controller. The comparator compares the first PWM signal to a measured output current signal and regulates the output current to the LEDS in the closed loop control until a predetermined output dimming level is reached. Upon reaching the predetermined output dimming level, the controller generates the second PWM signal to another comparator, and the output current is maintained at a preset value determined by calibration during the closed loop control.

20 Claims, 5 Drawing Sheets

(56) References Cited

U.S. PATENT DOCUMENTS

| | | | | |
|---|---|---|---|---|
| 2017/0215240 | A1* | 7/2017 | Sawada | H05B 33/0815 |
| 2018/0054865 | A1* | 2/2018 | Yang | H05B 33/0845 |

* cited by examiner

DEEP DIMMING CONTROL IN LED LIGHTING SYSTEM

I. TECHNICAL FIELD

The present invention relates generally to a method of deep dimming in lighting systems. In particular, the present invention relates to performing deep dimming control of a light emitting diode (LED) lighting system.

II. BACKGROUND

LEDs are current-dependent elements and in LED lighting system, LED driver control systems control this current. More specifically, an LED driver control system is connected between a power source (e.g., an AC power supply) and the LEDs for controlling the current supplied to the LEDs.

Some LED driver configurations employ pulse width modulation (PWM) to switch the output on and off which controls the output current to the LEDs. In these configurations, PWM provides control for alternating the brightness of the light output from the LEDs. PWM dimming is typically controlled by current via supply of a pulsed signal with a varying duty cycle to the LEDs.

Deep dimming of LEDs within a lighting system is becoming an increasingly preferred effect. The deep dimming process involves dimming the LEDs to approximately a 1% output current level without having any visible flickering of the LEDs. In current lighting systems, as the level of dimming decreases, other components of the LED driver enter a burst mode operation which results in undesirable visible flickering in the LEDs of the lighting system.

III. SUMMARY OF THE EMBODIMENTS

Given the aforementioned deficiencies, there is a need to provide a method of performing PWM dimming to reduce the potential of burst mode of operation and in the undesirable effects.

Embodiments of the present invention provide a driver control circuit for controlling brightness to a plurality of LEDs, that includes a controller which generates a first pulse width modulation signal, and a second pulse width modulation signal used respectively when switched between closed loop control and open loop control of the light intensity of the LEDs, and at least one comparator (e.g., an operational amplifier) configured to receive the first PWM signal from the controller. The comparator compares the first PWM signal to a measured output current signal and regulates the output current to the LEDS in the closed loop control until a predetermined output dimming level is reached. Upon reaching the predetermined output dimming level, the controller switches to open loop control and generates the second PWM signal to another comparator (e.g., an operational amplifier), and the output current is maintained at a preset value, determined by calibration during the closed loop control.

Other embodiments of the present invention include an LED lighting system employing the driver control circuit, and a deep dimming control method implemented using the above-mentioned driver control circuit.

The foregoing has broadly outlined some of the aspects and features of various embodiments, which should be construed to be merely illustrative of various potential applications of the disclosure. Other beneficial results can be obtained by applying the disclosed information in a different manner or by combining various aspects of the disclosed embodiments. Accordingly, other aspects and a more comprehensive understanding may be obtained by referring to the detailed description of the exemplary embodiments taken in conjunction with the accompanying drawings, in addition to the scope defined by the claims.

IV. DESCRIPTION OF THE DRAWINGS

Figure 1:
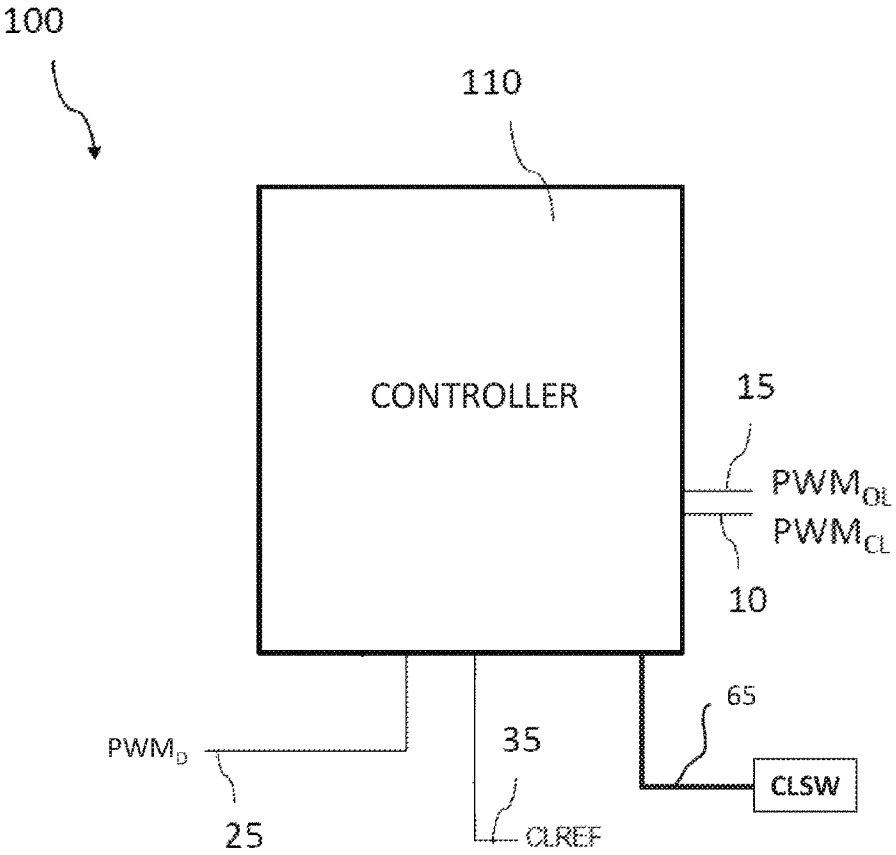
FIG. 1 is a schematic illustrating a controller of the driver control circuit according to one or more embodiments of the present invention.

The drawings are only for purposes of illustrating preferred embodiments and are not to be construed as limiting the disclosure. Given the following enabling description of the drawings, the novel aspects of the present disclosure should become evident to a person of ordinary skill in the art. This detailed description uses numerical and letter designations to refer to features in the drawings. Like or similar designations in the drawings and description have been used to refer to like or similar parts of embodiments of the invention.

V. DETAILED DESCRIPTION OF THE EMBODIMENTS

As required, detailed embodiments are disclosed herein. It must be understood that the disclosed embodiments are merely exemplary of various and alternative forms. As used herein, the word "exemplary" is used expansively to refer to embodiments that serve as illustrations, specimens, models, or patterns. The figures are not necessarily to scale and some features may be exaggerated or minimized to show details of particular components.

In other instances, well-known components, apparatuses, materials, or methods that are known to those having ordinary skill in the art have not been described in detail in order to avoid obscuring the present disclosure. Therefore, specific structural and functional details disclosed herein are not to be interpreted as limiting, but merely as a basis for the claims and as a representative basis for teaching one skilled in the art.

As noted above, the embodiments provide a driver control circuit for controlling the current supply to LEDs in an LED lighting system. The driver control circuit combines closed loop current regulation at higher current levels, along with switches, to provide open loop PWM dimming at lower levels (e.g., 10% of full light output). The closed loop current regulation provides appropriate output current until a predetermined dimming level is reached.

A calibration operation is performed during manufacturing, to detect the signal to the LED driver circuit at various closed loop control points. The controller uses the determined coefficients for transfer functions when performing the open loop PWM dimming operation to achieve the highest possible output accuracy.

Figure 2:
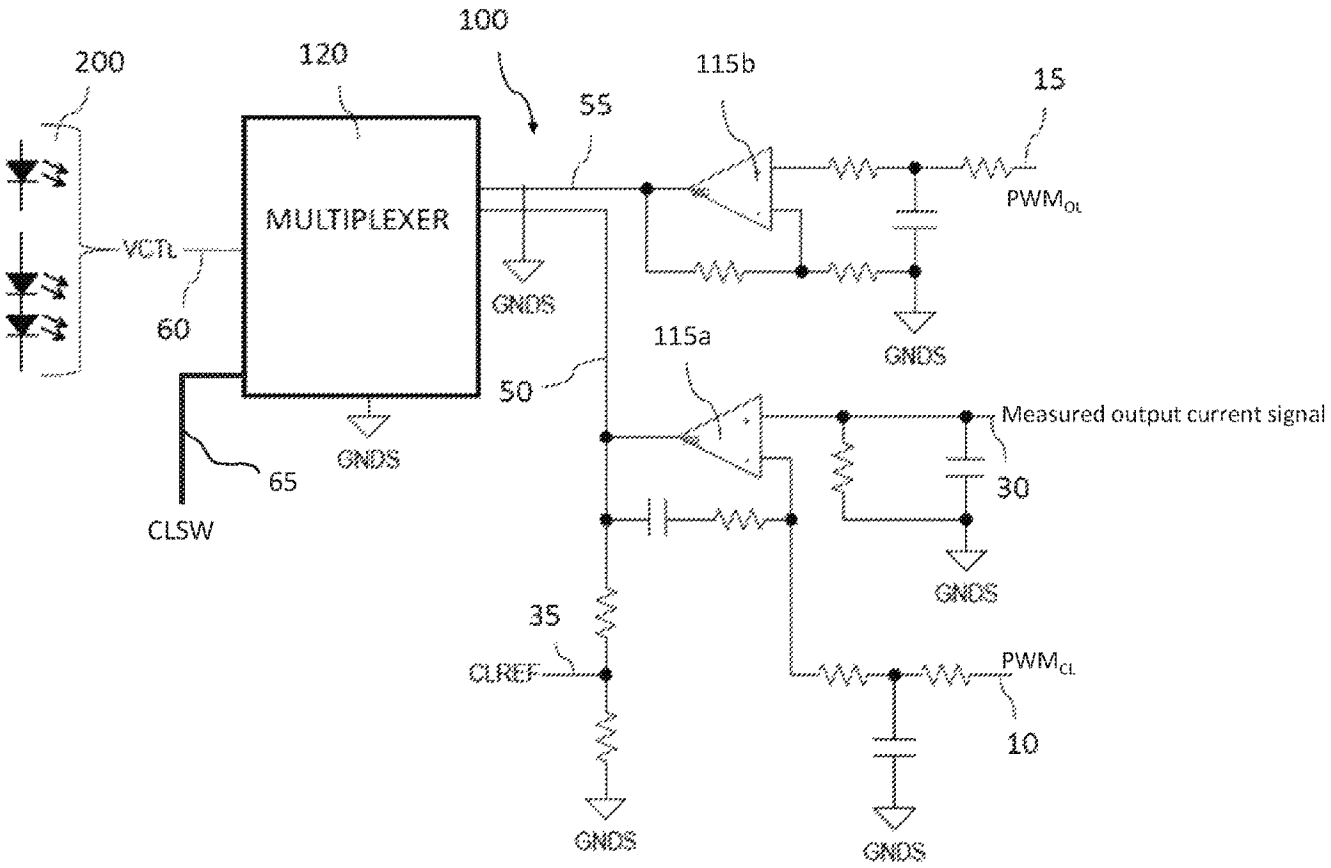
FIG. 2 is a schematic illustrating other components of the driver control circuit to be controlled by the controller of FIG. 1 that can be implemented within one or more embodiments of the present invention.

As shown in FIGS. 1 and 2, embodiments of the present invention provide a driver control circuit 100 for controlling the light intensity of LEDs 200 in a lighting system.

In FIG. 1, the driver control circuit 100 includes controller 110 for controlling the light intensity of LEDs 200 (as depicted in FIG. 2). The driver control circuit 110 is included in an LED driver of an LED lighting system. By way of example, the LED driver can include a flyback converter to receive power from an alternating current (AC) or direct current (DC) power source and transfer the power to a driver control circuit (e.g., a buck, boost, flyback, or buck-boost converter).

The controller 110 can be a microprocessor arranged to execute software and/or hardware based applications, driver programs, and instructions for controlling the output current to the LEDs 200.

Figure 3:
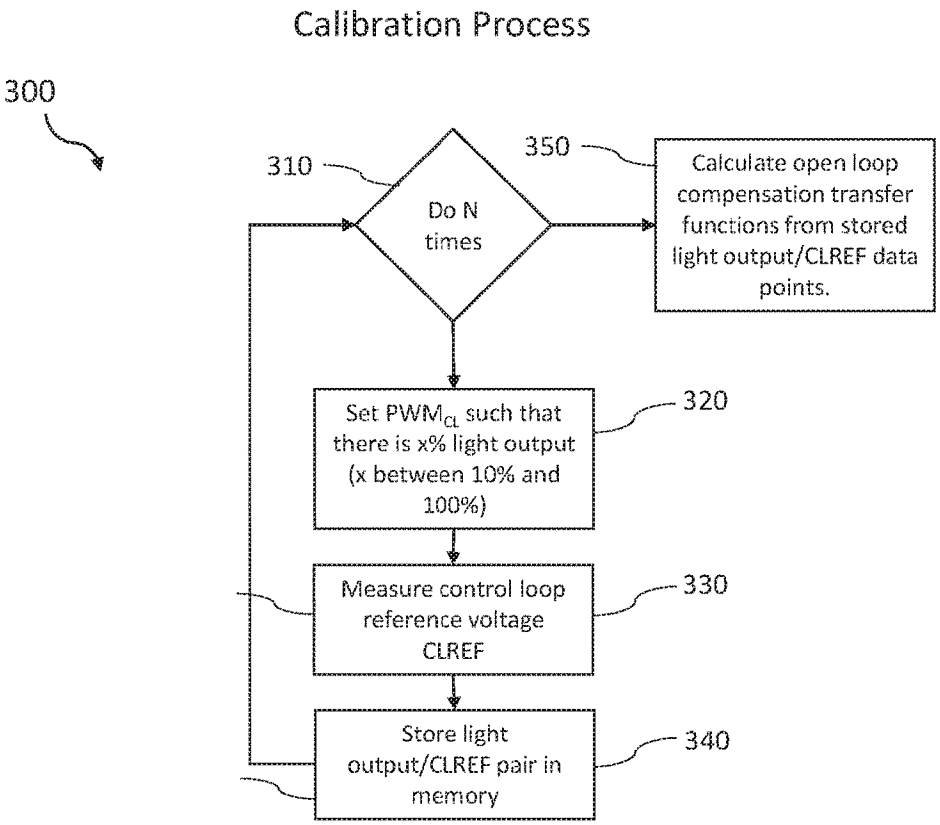
FIG. 3 is a flow diagram illustrating a calibration process to be performed according to one or more embodiments of the present invention. a deep dimming control method that can be implemented within one or more embodiments of the present invention.

In the exemplary embodiment of FIG. 1, the controller 110 sends a pulse width modulated control (PWM) signal 25 to control an on/off state thereof. The control (PWM) signal 25 is desirably of a fixed duty cycle. A current reference level (CLREF) signal 35 is available for measurement and is used while performing a calibration process (e.g. during manufacturing) (as depicted in FIG. 3, for example).

The CLREF signal 35 is measured at various points during closed loop control and is used to determine the correct duty cycle for open loop control mode. The calibration process can be performed once at manufacturing time, at each power cycle, periodically during normal runtime operation, or at other intervals suitable for the application at hand. At operation 310 of the method 300 shown in FIG. 3, the calibration process forces the light output to several pre-configured calibration set points N. According to an embodiment the set points N can range from approximately 2 to 10. At operation 320, the set points N are for example, at 100%, 50%, and 10%, and at each set point N, measures the control loop reference voltage, at operation 330. This allows for the determination of transfer function coefficients at operation 350 discussed below (for example, a slope and an offset in a linear transfer function). In one embodiment, several piecewise linear transfer functions are calculated, with each piece only valid between two neighboring set points (for example, a unique set of coefficients between 10% and 50%, and another set of coefficients between 50% and 100%). These functions enable the calculation of the reference voltage, when a measurement is not possible (during open loop operation, the reference voltage is not applicable). Thus it takes the form (Control Loop Reference Voltage)=K1*(Desired Output Current)+K2. In one embodiment, this calculated reference voltage is then used to determine the PWMoL duty cycle, which sets the amplitude of the output current to the desired output current.

According to other embodiments of the present invention, the calibration process can be performed at the controller 110 in real-time, during the closed loop control process. At operation 340, the light output and the CLREF signal 35 (as shown in FIG. 1) can be stored in memory at the controller 110 for use during the open loop control process. After operation 340, the process continues to operation 350, where the open loop compensation transfer functions are calculated from stored light output/CLREF data points.

Referring back to FIG. 1, The controller 110 generates a first pulse width modulation ($PWM_{CL}$) signal 10, and a second pulse width modulation ($PWM_{OL}$) signal 15 used respectively when switched between closed loop control and open loop control of the light intensity of the LEDs 200. Although the present application describes the use of PWM, other modulation schemes and techniques, for example, pulse frequency modulation (PFM), or a simple DAC output of a microprocessor could be used which would not require PWM or filtering, are within the scope of the present invention.

As shown in FIG. 2, at least one comparator or operational amplifier 115*a*, 115*b* is provided. Although two comparators/operational amplifiers are shown, there present invention is not limited hereto. The comparator 115*a* is configured to receive the first $PWM_{CL}$ signal 10 from the controller 110 during closed loop control, and compares the first $PWM_{CL}$ signal 10 to a measured output current signal 30. Thus, the comparator 115*a* regulates the output current to the LEDS 200 during closed loop control until a predetermined output dimming level is reached. The first $PWM_{CL}$ signal 10 can be filtered using a suitable filter such as a low pass filter to obtain the average value of the PWM signal. According to one or more embodiments, the predetermined closed loop output dimming level can range from approximately 10% to 20% of the full output light level of the LEDs 200.

In the example of FIG. 2, a multiplexer 120 is connected between at least one comparator 115*a* or 115*b*, and the power converter controlling LEDs 200. The multiplexer 120 supplies a voltage control (VCTL) signal 60 to the power converter for regulating the output current thereto. The VCTL signal 60 is controlled by the controller 110 to operate in a closed loop or open loop control mode determined by the state of control loop switch (CLSW) signal 65. The controller 110 also receives an output signal (e.g., CLREF signal 35) from the at least one comparator 115*a* or 115*b*. During the closed loop control, the output signal 50 of the comparator 115*a* is connected by the multiplexer 120 to VCTL signal 60 for controlling the power converter. As shown, the multiplexer 120 connects either output signal 50 or 55 to the VCTL signal 60 depending on the state of the CLSW signal 65. In one state, it internally connects output signal 50 to the VCTL signal 60, and in another state it connects output signal 55 to the VCTL signal 60. Alternatively, according to other embodiments, the connections could be done discretely with transistors or analog switches.

Controller 110 generates and provides a second PWMoL signal 15 to the at least one comparator 115*b*. Upon reaching a predetermined output dimming level, controller 110 changes the state of CLSW signal 65 to multiplexer 120, connecting output signal 55 to VCTL signal 60. The power converter now operates in open loop control and the VCTL signal 60 is controlled based on the output signal 55. These processes maintain the output current at a preset value, as determined by calibration during the closed loop control. For example, the controller 110 starts out with pre-programmed constants (presets) for the linear transfer functions. There are two transfer functions (i.e., two slopes and two offsets). The slopes are in units of mV/%, and the offsets in units of mV, since as stated earlier the equation is "reference voltage (mV)=light output (%)*K1 (mV/%)+K2 (mV)". The preset values are roughly 1400 mV/% for K1 and 2000 mV for K2 (40% to 100% output amplitude range), and 2400 mV/% for K1 and 2400 mV for K2 (10% to 40% output amplitude range).

During the PWM dimming, the control ($PWM_D$) signal 25 is at a fixed duty cycle and the VCTL signal 60 is varied to produce the desired average output current. This allows deep dimming (e.g., 1% average output current) without visible flickering of the LEDs. 200. $PWM_D$ signal 25 goes to the power converter that receives VCTL signal 60. The $PWM_D$ signal 25 disables the power converter from operating. For example, if $PWM_D$ signal 25 is high, the power converter is in an off state. Once $PWM_D$ signal goes low, the power converter operates normally, regulating the current based on VCTL voltage.

Figure 4:
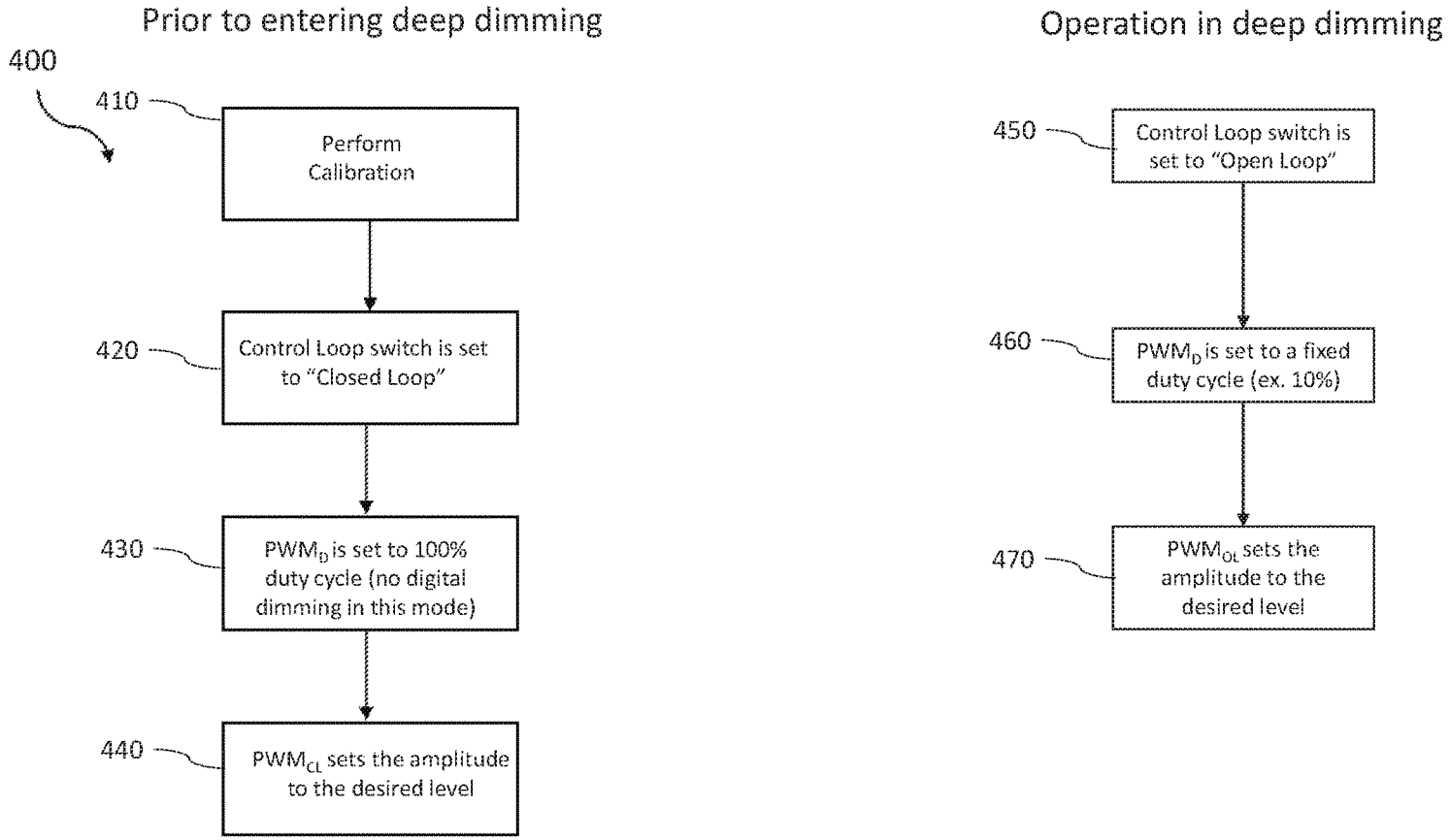
FIG. 4 is a flow diagram illustrating a deep dimming control method that can be implemented within one or more embodiments of the present invention.

A deep dimming control method implemented using the driver control circuit 100 shown in FIGS. 1 and 2 will now be discussed with reference to FIG. 4. FIG. 4 is a flowchart of an exemplary method 400 of implementing an embodiment of the present invention.

Prior to entering deep dimming, method 400 begins at operation 410, where the calibration is performed via the controller of the driver control circuit. The CLREF signal 35 is measured at various points during a closed loop control performed by the controller. In the embodiments, the CLREF signal 35 is stored in memory for use during the open loop control performed by the controller. Storage of the CLREF signal 35 provides an ability to mimic the VCTL signal to the LEDs while operating in open mode.

The process continues to operation 420 where the controller ensures that the multiplexer switch is in the "closed loop" position. From operation 420, the process continues to operation 430. In operation 430, the controller ensures that the PWM D signal is continuously exerted, such that the power converter is on at 100% duty cycle.

In operation 440, $PWM_{CL}$ is used as an output signal to the comparator, which is sent to a multiplexer connected between the comparator and the LEDs to supply a voltage control signal for regulating the output current thereto. If the dimming level drops below a predetermined output dimming level threshold, the controller generates a second PWM signal (PWMoL) to be sent to the comparator in an open loop control. Next the method 400 continues to operation 450, where a control loop switch (CLSW) connected to the multiplexer is switched to open loop control, which switches where the voltage control signal is controlled to maintain the output current at a preset value. This preset value is equivalent to the current reference level signal as determined by the calibration during the closed loop control.

At operation 460, the PWM D signal is set to a fixed duty cycle (e.g., 10%) and then at operation 470, the PWMoL signal sets the amplitude to the desired level.

Figure 5:
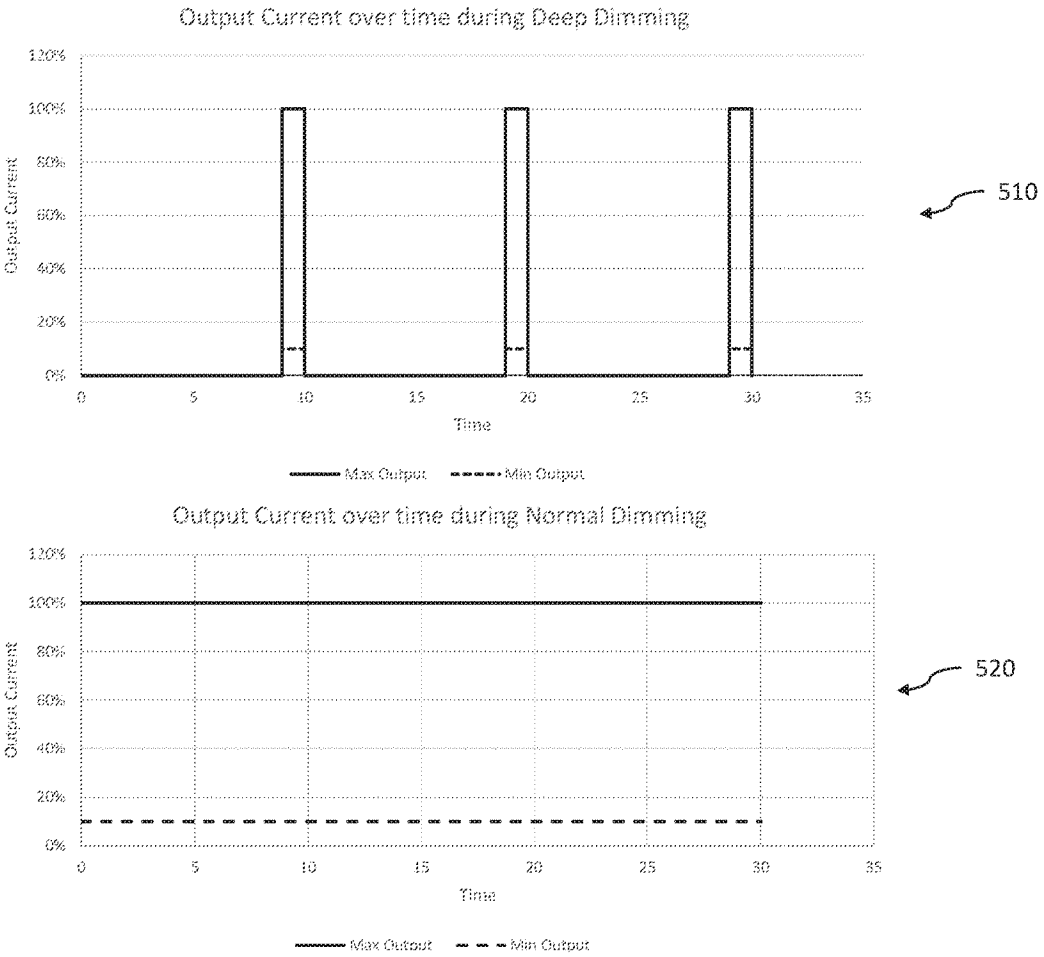
FIG. 5 is are graphical illustrations of output current over time during a deep dimming operation compared to output current over time during a normal dimming operation, that can be implemented within one or more embodiments of the present invention.

FIG. 5 are graphical illustrations of a comparison between output current over time during a deep dimming operation vs. output current over time during a normal dimming operation. As shown in FIG. 5, in graphical illustration 510, during deep dimming, average output is calculated as average output is calculated as (% amplitude)*(% duty cycle). In this example, Max Average output during Deep Dimming is (100%)*(10%)=10%, and Min Average output during Deep Dimming is (10%)*(10%)=1%. In graphical illustration 520, during normal dimming, average output is calculated as simply (% amplitude). In this example, Max Average output during Normal Dimming is 100%, and Min Average output during Normal Dimming is 10%.

Embodiments of the present invention provide the advantages of performing deep dimming in LED lighting systems while preventing unwanted flickering of the LEDs during the dimming process.

This written description uses examples to disclose the invention including the best mode, and also to enable any person skilled in the art to practice the invention, including making and using any devices or apparatuses and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A driver control circuit for controlling brightness to a plurality of light emitting diodes in a lighting system, comprising:

a controller configured to generate a first pulse width modulation signal, and a second pulse width modulation signal used respectively when switched between closed loop control and open loop control to control an output current signal to the light emitting diodes; and a first comparator connected with the controller and configured to:

compare the first pulse width modulation signal to a measured output current signal and regulates the output current to the light emitting diodes in the closed loop control until a predetermined output dimming level is reached, and upon reaching the predetermined output dimming level, and a second comparator connected with the controller and configured to:

receive the second pulse width modulation signal from the controller, wherein the output current signal is maintained at a preset value, as determined by calibration during the closed loop control.

2. The driver control circuit of claim 1, wherein the controller is further configured to perform calibration operation comprising: (i) detecting a current reference level signal to the driver control circuit at various closed loop control points, and (ii) determining coefficients for transfer functions to be performed during open loop control.

3. The driver control circuit of claim 2, wherein the calibration operation is performed during manufacturing.

4. The driver control circuit of claim 2, wherein the calibration operation is performed in real-time during the closed loop control.

5. The driver control circuit of claim 2, wherein the current reference level signal is stored within the controller for use during the open loop control.

6. The driver control circuit of claim 5, wherein the predetermined dimming level ranges from approximately 1% to approximately 20% of a full output light level of the light emitting diodes.

7. The driver control circuit of claim 5, further comprising:

a multiplexer connected between the at least one comparator and the light emitting diodes, and configured to supply a voltage control signal for regulating the output current to the light emitting diodes, wherein during the closed loop control the multiplexer receives an output signal from the first comparator for regulating the output current signal based on the measured output current signal, and upon switching to open loop control the multiplexer receives an output signal from the second comparator for regulating the output current signal based on the current reference level signal stored at the controller.

8. The driver control circuit of claim 5, wherein a control signal of the controller operates at a fixed duty cycle, and the voltage control signal from the multiplexer is varied to produce the output current signal desired to enable deep dimming of the light emitting diodes.

9. The driver control circuit of claim 8, wherein the deep dimming is approximately 1% of the output current to the light emitting diodes.

10. A light emitting diode lighting system, comprising:

at least one light emitting diode; and a driver control circuit for controlling brightness to a plurality of light emitting diodes in a lighting system, comprising:

a controller configured to generate a first pulse width modulation signal, and a second pulse width modulation signal used respectively when switched between closed loop control and open loop control to control an output current signal to the light emitting diodes, and a first comparator connected with the controller and configured to:

compare the first pulse width modulation signal to a measured output current signal and regulates the output current to the light emitting diodes in the closed loop control until a predetermined output dimming level is reached, and upon reaching the predetermined output dimming level, and a second comparator connected with the controller and configured to:

receive the second pulse width modulation signal from the controller, wherein the output current signal is maintained at a preset value, as determined by calibration during the closed loop control.

11. The system of claim 10, wherein the controller is further configured to perform a calibration operation comprising:

(i) detecting a current reference level signal to the driver control circuit at various closed loop control points, and (ii) determining coefficients for transfer functions to be performed during open loop control.

12. The system of claim 11, wherein the calibration operation is performed during manufacturing.

13. The system of claim 11, wherein the calibration operation is performed in real-time during the closed loop control.

14. The system of claim 11, wherein the current reference level signal is stored within the controller for use during the open loop control.

15. The system of claim 14, wherein the predetermined dimming level ranges from approximately 1% to approximately 20% of a full output light level of the light emitting diodes.

16. The system of claim 14, wherein the driver control circuit further comprising:

a multiplexer connected between the first comparator and the second comparator, and the light emitting diodes, and configured to supply a voltage control signal for regulating the output current to the light emitting diodes, wherein during the closed loop control the multiplexer receives an output signal from the first comparator for regulating the output current signal based on the measured output current signal, and upon switching to open loop control the multiplexer receives an output signal from the second comparator for regulating the output current signal based on the current reference level signal stored at the controller.

17. A deep dimming control method comprising:

performing, via a controller, a calibration operation by measuring a current reference level signal at various points during a closed loop control generating, via the controller a first pulse width modulation signal for performing the closed loop control;

comparing, via a first comparator, the first pulse width modulation signal to a measured output current signal and regulating the output current to light emitting diodes in the closed loop control until a predetermined output dimming level is reached; and upon reaching the predetermined output dimming level, receiving a second pulse width modulation signal, via a second comparator, from the controller, wherein the output current signal is maintained at a preset value, as determined by the calibration operation during the closed loop control.

18. The method of claim 17, further comprising:

storing the current reference level signal in memory for use during the open loop control.

19. The method of claim 17, wherein the calibration operation comprising:

detecting the current reference level signal at various closed loop control points; and determining coefficients for transfer functions to be performed during the open loop control.

20. The method of claim 19, wherein the calibration operation is performed during manufacturing.

* * * * *